US011732491B2

(12) United States Patent
Lee et al.

(10) Patent No.: US 11,732,491 B2
(45) Date of Patent: Aug. 22, 2023

(54) PORTABLE DEVICE FOR INJECTING CONCRETE REPAIR MATERIAL

(71) Applicants: Hyang Dong Lee, Seongnam-si (KR); Jong Woo Lee, Seongnam-si (KR)

(72) Inventors: Hyang Dong Lee, Seongnam-si (KR); Jong Woo Lee, Seongnam-si (KR)

( * ) Notice: Subject to any disclaimer, the term of this patent is extended or adjusted under 35 U.S.C. 154(b) by 160 days.

(21) Appl. No.: 17/386,874

(22) Filed: Jul. 28, 2021

(65) Prior Publication Data

US 2022/0412109 A1 Dec. 29, 2022

(30) Foreign Application Priority Data

Jun. 24, 2021 (KR) ..... 10-2021-0082182

(51) Int. Cl.

| | |
|---|---|
| ***E04G 23/02*** | (2006.01) |
| ***B05B 7/00*** | (2006.01) |
| ***B05B 7/04*** | (2006.01) |

(52) U.S. Cl.

CPC ..... *E04G 23/0211* (2013.01); *B05B 7/0093* (2013.01); *B05B 7/0408* (2013.01)

(58) Field of Classification Search

None

See application file for complete search history.

(56) References Cited

FOREIGN PATENT DOCUMENTS

| | | | | |
|---|---|---|---|---|
| JP | 2000-309193 A | | 11/2000 | |
| KR | 10-2019-0069765 A | | 6/2019 | |
| KR | 10-2020009 B1 | | 9/2019 | |
| KR | 10-2021-0062863 A | | 6/2021 | |
| WO | WO02079678 A1 | * | 10/2002 | ..... E03C 1/104 |
| WO | WO2011079395 A1 | * | 7/2011 | ..... B29B 7/04 |

OTHER PUBLICATIONS

Weis WO02079678A1 English Translation 2002 (Year: 2002).*

* cited by examiner

*Primary Examiner* — Jacob T Minskey
*Assistant Examiner* — Adrien J Bernard
(74) *Attorney, Agent, or Firm* — KORUS Patent, LLC; Seong Il Jeong

(57) ABSTRACT

The present invention provides a portable device for injecting repair material, the portable device comprising: a chassis frame; tanks storing source materials; pumping means pumping the source materials; an injection nozzle mixing the source materials and injecting repair material into cracks; source material supplying means including: operating blocks connected to the pumping means; supplying pipes connected to the operating blocks and supplied with the source materials; transferring pipes connected to the operating blocks and transferring the source materials into the injection nozzle, and a pressure controller connected to the transferring pipe and controlling the source materials, wherein check valves for preventing backflow are installed inside the transferring pipes, wherein by adjusting another check valve connected to the pressure controller, an amount of the repair material for injection is controlled.

7 Claims, 7 Drawing Sheets

PORTABLE DEVICE FOR INJECTING CONCRETE REPAIR MATERIAL

FIELD OF THE INVENTION

The present invention relates to a portable device for injecting concrete repair material and more particularly, a portable device for injecting concrete repair material that allows repair material, a mixture of main agent and curing agent, to be injected smoothly to cracks of concrete structures and to increase durability of the motor of the device.

BACKGROUND OF THE INVENTION

In general, cracks in concrete buildings and civil structures occur due to various causes. When foreign objects such as rainwater permeates the cracks, rainwater penetrates further into the building due to capillary phenomenon, which expands the gap due to temperature change or pressure difference, or erodes the underlying structures such as rebar, thereby causing the collapse of the structure in severe cases.

Accordingly, repair material is injected to repair the cracks, and normally, the repair material injection device is used for injecting the source materials. In other words, the repair material injection device is used to forcibly inject epoxy, such as a mixture of a main agent and a curing agent, to seal the cracks with epoxy coagulation or to allow epoxy to waterproof and to prevent further cracks with adhesive force.

Conventional epoxy injection devices have problems of leakage of main agent and curing agent when a piston linearly reciprocates along the cylinder. Multiple sealing rings consisting of rubber or silicone materials are used to solve this problem; however, these sealing rings become worn down, thereby causing leakage of the main agent and the curing agent and dislocation of the sealing rings.

In order to solve these problems, there is Korean Patent No. 10-2020009 registered by the present applicant. The patent above is a portable injecting device for reinforcing concrete structure. The portable injecting device comprises: a chassis frame having a movable wheel and a handle; a tank storing a main agent and a curing agent, separately; a pumping means pumping the main agent and the curing agent; and an injection nozzle injecting repair material, a mixture of the main agent and the curing agent pumped by the pumping means, to cracks in concrete structures. The pumping means include: a first and a second cylinder, which are separably installed in the chassis, respectively, and supplied with the main agent and the curing agent stored in the tank; a first and a second piston pumping the main agent and the curing agent, respectively, by reciprocating motion inside the first and the second cylinder using a driver as a driving source; a first and a second backflow prevention valve movably installed in front of the first and the second piston through a first and a second return spring, supplying the main agent and the curing agent to the injection nozzle through a circumference part by moving the main agent and the curing agent forward when the first and the second piston move forward, and closing a discharging hole through which the main agent and the curing agent are discharged when the first and the second piston move backward. In this instance, the first and the second backflow preventer valve include: a first and a second valve body opening and closing the discharging hole; a first and a second core part formed in one side of the first and the second valve body with an outer diameter smaller than that of the first and the second valve body; a first and a second spring fixing part connected to one side of the first and the second return spring with an outer diameter smaller than that of the first and the second core part; a first and a second inducing groove formed to communicate with the injection nozzle inside the first and the second spring fixing part and assisting the backward of the first and the second valve body by allowing the main agent and the curing agent to flow into the inside when the first and the second piston move backward; and a first and a second inducing hole arranged to open toward the perimeter part inside the first and the second core in radial layout and to communicate with the first and the second inducing groove, thereby preventing contamination caused by stagnant main agent and curing agent. The portable injecting device above can be freely moved around to repair cracks inside concrete buildings; however, it often has failures of the motor due to leakage of the materials inside the piston and cylinder, output limits of the motor, and difficulties with control of the discharge amount of repair material.

Therefore, there is a need for an improved repair material injection device that can be adjusted according to a discharge amount of repair material and limits of the motor.

The prior art document is Korean Patent No. 10-2020009.

The purpose of this invention to solve the problems as mentioned above is to provide a portable device for injecting concrete repair material that can repair cracks by injecting main agent and curing agent using pumping of the piston while freely moving around inside a concrete structure and preventing contamination and damage of the device caused by leakage of the main agent and curing agent through backflow prevention of these materials.

The other purpose of this invention is to provide a portable device for injecting concrete repair material with a first to a third check valve and a pressure controller connected to the third check valve control on the path through which the repair material is transported, thereby allowing the discharge amount of repair material constant, and preventing damages of the motor caused by the limits of the motor capacity and the number of rotations.

SUMMARY OF THE INVENTION

The present invention provides a portable device for injecting repair material, the portable device comprising: a chassis frame including a movable wheel and a handle; tanks mounted on the chassis frame and storing source materials including a main agent and a curing agent, separately; pumping means pumping the main agent and the curing agent stored in the tanks by a driving part of a motor; an injection nozzle mixing the main agent and the curing agent pumped by the pumping means into repair material and injecting the repair material into cracks of a concrete structure; source material supplying means that are separately installed between the pumping mean and the injection nozzle, supplied with the source materials from the tank, and transfer the source materials into the injection nozzle, the source material supplying means including: a first and a second operating block that are connected to the pumping means and each consists of a cylinder and a piston that discharge the source materials; a first and a second supplying pipe that are respectively connected to one sides of the first and the second operating block and are supplied with the source materials from the tanks; a first and a second transferring pipe that are connected to the fronts of the first and the second operating block and transfer the source materials into the injection nozzle, and a pressure controller that is connected to one of the first and the second transferring pipe and that controls an amount of the source materials, wherein a first and a second check valve for preventing backflow are installed inside the first and the second transferring pipe, respectively, wherein by adjusting a third check valve that is connected to the pressure controller, a discharge amount of the source materials is adjusted, and the repair material for injection is controlled.

In addition, the first and the second operating block including: a first and a second piston rod that are connected to the pumping means through pins; a first and a second cylinder both sides of which open in a longitudinal direction, and one sides of which the first and the second piston rod are connected to; oil seals that are inserted into the backs of the first and the second cylinder and that prevent leakage of the source materials, q and sockets that the first and the second rod penetrate through, and that are placed at the backs of the oil seals through screw connections, wherein the first and the second piston rod further include o-rings that are put on outer circumferences of one ends thereof.

Furthermore, the o-rings formed on the outer circumferences of the first and the second piston rod include at least three o-rings that are arranged with constant spacing in a longitudinal direction of the first and the second piston rod.

Moreover, the first and the second transferring pipe include: transferring pipe bodies; transferring passages that the source materials are transferred through; and valve-sitting raised spots that are formed at the transferring passages with inner diameters that is smaller than that of the transferring passage, wherein a first and a second check valve are formed at the valve-sitting raised spots, and each includes: a backflow prevention valve that opens and closes the transferring passage, and an elastic spring that is closely connected to the backflow prevention valve.

Each of the first and the second transferring pipe includes: a valve head part that sits on the valve-sitting raised spot, opens and closes the transferring passage; a core part that is extended from the valve head part and that has an outer diameter that is smaller than that of the valve head part, a spring fixing part that has an outer diameter that is smaller than that of the core part and that is connected to the elastic spring; a guiding groove that is formed inside the spring fixing part and that opens toward the transferring passage, and a guiding hole that is formed inside the core part and that communicates with the guiding groove.

In addition, the pressure controller includes: a pipe junction part that meets with one of the first and the second transferring pipe; a pipe connecting part that extends backward in a longitudinal direction, and a body that is fixed on the top of the chassis frame, connected to the pipe connecting part, and has a pressure control knob on the top thereof.

Furthermore, the portable device further comprises a third check valve that is formed inside one of the first and the second transferring pipe that is connected to the pressure controller, in order to control the source materials transferred through the transferring pipe, according to pressure difference, wherein the third check valve opens and closes according to control of the pressure controller, wherein a pressure gauge is installed at one side of the injection nozzle, and allows a user to check gauge while controlling the pressure controller and injecting the repair material.

Moreover, at the bottom of the tank includes at least 4 protrusion extending parts, wherein the protrusion extending part includes an inner introducing groove that is formed inward thereof to be engaged with a protruding part that is protrudingly formed on the chassis frame, so that the tank is stably placed on the top of the chassis frame.

TECHNICAL EFFECTS OF THE INVENTION

The present invention provides a portable device for injecting concrete repair material that can freely move around inside a concrete structure and repair cracks by injecting main agent and curing agent with a piston pumping at the sites of the cracks and can ensure backflow prevention of the main agent and curing agent, thereby preventing contamination and damage of the device caused by leakage of these source materials.

In addition, since the present invention is small-size and portable, a user can freely transport the device to the sites of cracks inside concrete buildings and inject repair material into the cracks in the sites, thereby allowing an easy repair process. Furthermore, since the check valve can respond or return quickly to ensure prevention of backflow of the main agent and the curing agent in the pumping process of the piston, loss of the main agent and the curing agent, contamination at the concrete buildings, and damage of the device caused by leakage of these materials can be prevented.

Moreover, the present invention provides multiple o-ring structures to the shafts of the piston, thereby minimizing friction and allowing smooth operation of the device.

Additionally, the present invention is provided with a first to a third check valve and a pressure controller connected to the third check valve control on the path through which the repair material is transported, thereby allowing the discharge amount of repair material constant. The invention also includes a pressure controller, thereby preventing damages of the motor caused by the limits of the motor capacity and the number of rotations.

BRIEF DESCRIPTION OF THE DRAWINGS

FIG. 1 is an illustrative perspective view showing a portable device for injecting concrete repair material of the present invention.

FIG. 2 is an illustrative side view showing a pumping mean and a source material supplying mean according to a portable device for injecting concrete repair material of the present invention.

FIG. 3 is an illustrative top view showing pumping means and source material supplying means according to a portable device for injecting concrete repair material of the present invention.

FIG. 4 is a schematic top view showing an installation of a first and a second piston rod connected to the pumping means according to a portable device for injecting concrete repair material of the present invention.

FIG. 5 is an illustrative magnified view showing a first and a second operating block in a source material supplying mean according to a portable device for injecting concrete repair material of the present invention.

FIG. 6 is an illustrative view showing a first and a second piston rod in the first and the second operating block according to a portable device for injecting concrete repair material of the present invention.

FIG. 7 is an illustrative magnified view showing essential parts of a first and a second check valve installed in a first and a second transferring pipe in a source material supplying mean according to a portable device for injecting concrete repair material of the present invention.

FIG. 8 is an illustrative view showing a backflow prevention valve of the first and the second check valve in a source material supplying mean according to a portable device for injecting concrete repair material of the present invention.

FIG. 9 is an illustrative view showing a connection between a chassis frame and a tank according to a portable device for injecting concrete repair material of the present invention.

FIG. 10 is an illustrative view showing a connection port installed at the back of a chassis frame according to a portable device for injecting concrete repair material of the present invention.

DETAILED DESCRIPTION EMBODIMENTS OF THE INVENTIONS

Figure 1:
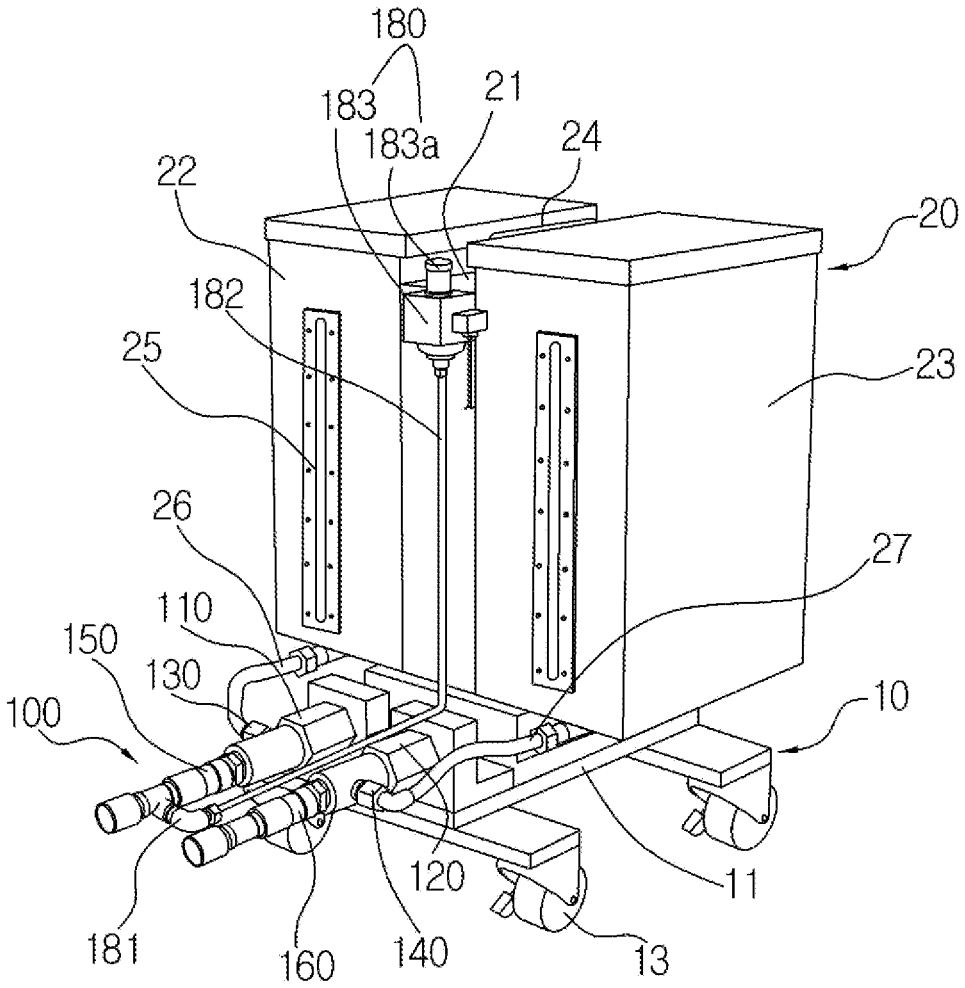
FIGS. 1 to 10 are embodiments of a portable device for injecting concrete repair material according to the present invention.

The present invention may be modified and have various embodiments. Some embodiments will be illustrated in accompanying drawings and explained in detail through specification; however, the embodiments disclosed herein do not limit the scope of the present invention and shall be understood that they include all of the modifications, the equivalents, and the substitutions thereof within the scope of the present invention.

The embodiments below are not restricting or limiting the scopes of the inventive concepts and can be embodied in various forms. The embodiments of the present embodiments are provided to assist a person of ordinary skill in the art to gain a comprehensive understanding of the present disclosure.

Hereafter, the present invention will be described in more detail in conjunction with the accompanying drawings. The same elements of the present invention illustrated in different figures are denoted by the same reference number. In addition, detailed explanation regarding related elements or functions, which are well known to a person of ordinary skill in the art, will be omitted in case it may obscure the gist of the present invention.

FIGS. 1 to 10 are embodiments of a portable device for injecting concrete repair material according to the present invention.

Referring to FIGS. 1 to 7, the portable device for injecting concrete repair material according to the present invention, comprises a chassis frame 10; a tank 20 storing and supplying a main agent and a curing agent, separately; a pumping means 50 pumping the main agent and the curing agent to spray them into the tank 20; and an injection nozzle 60 mixing the main agent and the curing agent pumped by the pumping means 50 to produce a repair material and injecting the repair material.

In this case, the portable device for injecting concrete repair material comprises source material supplying means that are separately installed between the pumping mean 50 and the injection nozzle 60, supplied with the source materials from the tank 20, and transfer them into the injection nozzle 60.

The chassis frame 10 includes a base frame 11 and a wheel 13 movably installed at the bottom of the base frame 11.

The base frame 11 is a structure that is surrounded by a floor part and a wall part of a perimeter part, and opens upward. The pumping means 50 including a motor and a driving part are installed inside the base frame 11.

The wheel 13 may be applied with a stopper to prevent the device of the present invention from moving during the injection process of the repair material.

The tanks 20 are installed in both sides of a tank frame 21, respectively, and may include a first tank 22 and a second tank 23. Each of the first tank 22 and the second tank 23 may store and supply the main agent and the curing agent, respectively.

The tank frame 21 may further include a handle 24 at the upper side thereof, thereby allowing a user to handle both the first and the second tank 22, 23 as a single task.

The first and the second tank 22, 23 are located on the left and the right side of the tank frame 21, respectively. Each of the first and the second tank 22, 23 stores the main agent and the curing agent, respectively, and includes a tank cover to supplement of the main agent and the curing agent, and a transparent window 25 to check the remaining amount of the main agent and the curing agent.

Desirably, the first and the second tank 22, 23 may be embodied as a fixed type, which is fixed to the tank frame 21 or as a drawer type, which is separably connected to the tank frame 21.

The first and the second tank 22, 23 is connected to a first and a second supply hose 26, 27, respectively, to supply the main agent and the curing agent into the pumping mean 50. The first and the second supply hose 26, 27 open and close by manual valves (not shown), respectively.

Meanwhile, the tank 20 is embodied to be placed on the top of the chassis frame 10 for assembly, and at the bottom of the tank 20 includes at least 4 protrusion extending parts 28. The protrusion extending part 28 may include an inner introducing groove 29 formed inward thereof, which can be engaged with a protruding part 14 protrudingly formed in the chassis frame 10. Accordingly, the tank 20 placed on the top of the chassis frame 10 can be stably fixed on it, and an installment process can also be easy.

The chassis frame 10 may include a power cord part 15 at the back thereof for connecting to a power source, and a control switch connecting part 16 for connecting to a pressure controller. In this case, both the power cord part 15 and the control switch connecting part 16 are embodied with the same type of two-hole connection port, thereby allowing a user including a beginner to easily complete connections regardless of the locations of the connecting ports without electrical accidents.

Figure 2:
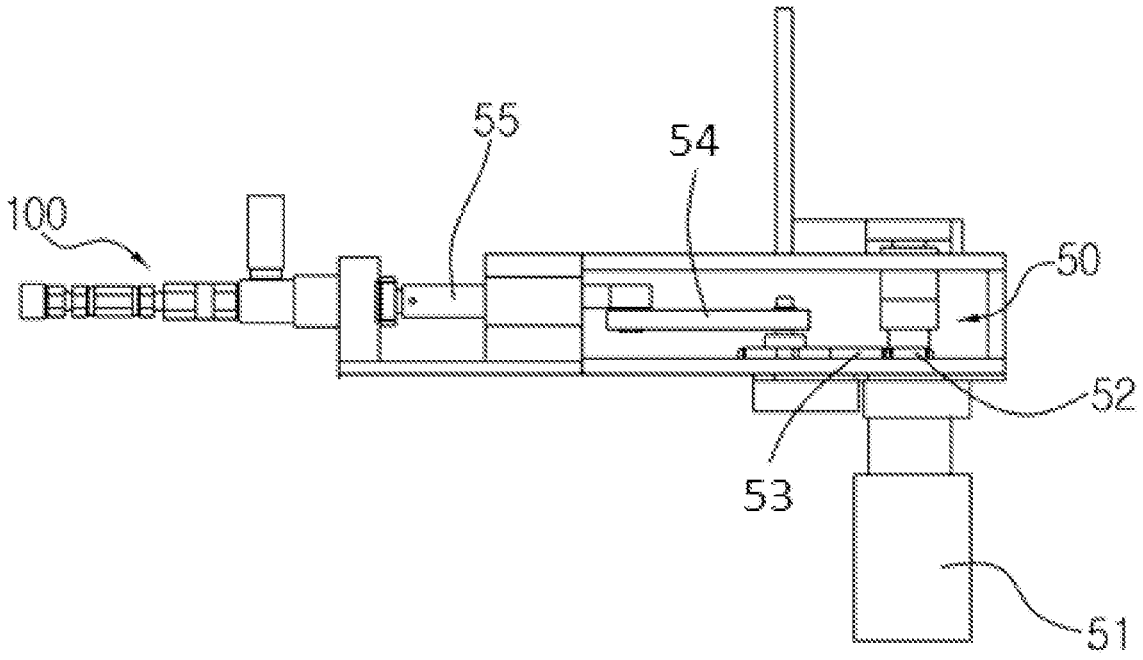
Figure 3:
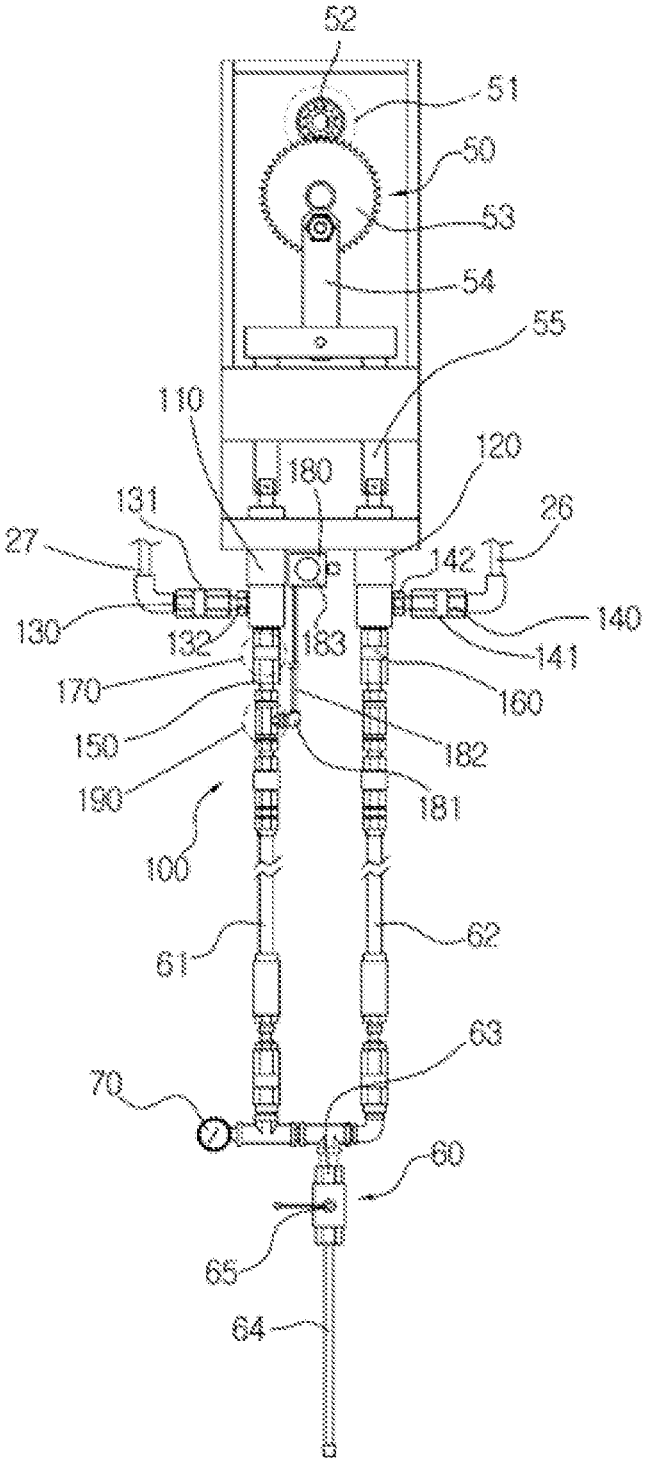

As illustrated in FIGS. 2 to 3, the pumping mean 50 includes: a motor 51; a driver gear 52 rotated by the rotational force of the motor 51; a follower gear 53 interlocked with the driver gear 52 and rotated by the force from the driver gear 52; a crank shaft 54 one side of which is connected to the follower gear 53, thereby converting the rotational motion to a linear straight-line motion, a linear motion operating shaft 55 moving in a linear reciprocating motion by the crank shaft 54, and a switch control the on/off of the motor 51.

The motor 51 is mounted on the chassis frame 10, and connected to the driver gear 52 in such a way that the driving shaft of the motor 51 is inserted into the inside of the chassis frame 10.

In some embodiments, various gearing tools that a user uses in construction sites may be used instead of the motor 51.

Desirably, the driver gear 52, the follower gear 53, the crank shaft 54, and the linear motion operating shaft 55 are installed to transfer driving power to the inside of the base frame 11 of the chassis frame 10 or convert a rotational motion to a linear motion.

The driver gear 52 includes a socket to which the rotary shaft of the motor 51 is connected.

The injection nozzle 60 includes: a first and a second injection hose 61, 62 that are respectively connected to the nipples of the pumping means 60; a mixing part 63 that is connected to the first and the second injection hose 61, 62 and that mixes the main agent and the curing agent; a nozzle 64 that sprays the repair material mixed in the mixing part 63 and that injects it into the cracks of the concrete structure; and an injection control valve 65 that controls start, stop, and an amount of spraying.

The first and the second injection hose 61, 62 may be embodied with various forms that can supply each of the main agent and the curing agent to the mixing part 63.

Desirably, the mixing part 63 is a component that mixes the main agent and the curing agent supplied from the first and the second injection hose 61, 62 and supplies the mixed materials, the repair material, to the nozzle 64. For example, the mixing part 64 may include: two inflow parts that is supplied with the main agent and the curing agent through the first and the second injection hose 61, 62, and a single merging part that is formed by merging of the two inflow parts the are supplied with the main agent and the curing agent.

The nozzle 64 is separably assembled to the merging part of the mixing part 63 and sprays the repair material. The injection control valve 65, for example a butterfly valve, can open and close the nozzle 64 and control the injection of the repair material. The injection control valve 65 is installed to be connected to a bare part that is held and controlled by a user.

The source material supplying means 100 includes a first and a second operating block 110, 120 consisting of a cylinder and a piston that discharge the source materials; a first and a second supplying pipe 130, 140 that are respectively connected to the first and the second operating block 110, 120 and that are supplied with the source materials from the tank 20; a first and a second transferring pipe 150, 160 that are connected to the fronts of the first and the second operating block 110, 120 and that transfer the source materials into the injection nozzle 60; and a pressure controller 170 that is connected to the first and the second transferring pipe 150, 160 and controls the source materials.

Figure 4:
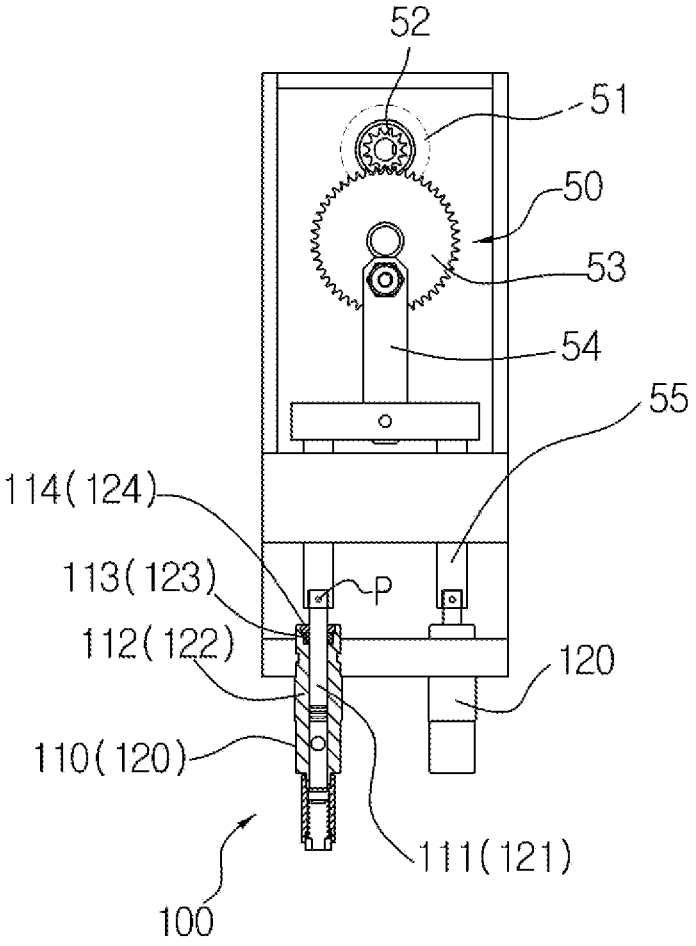
Figure 5:
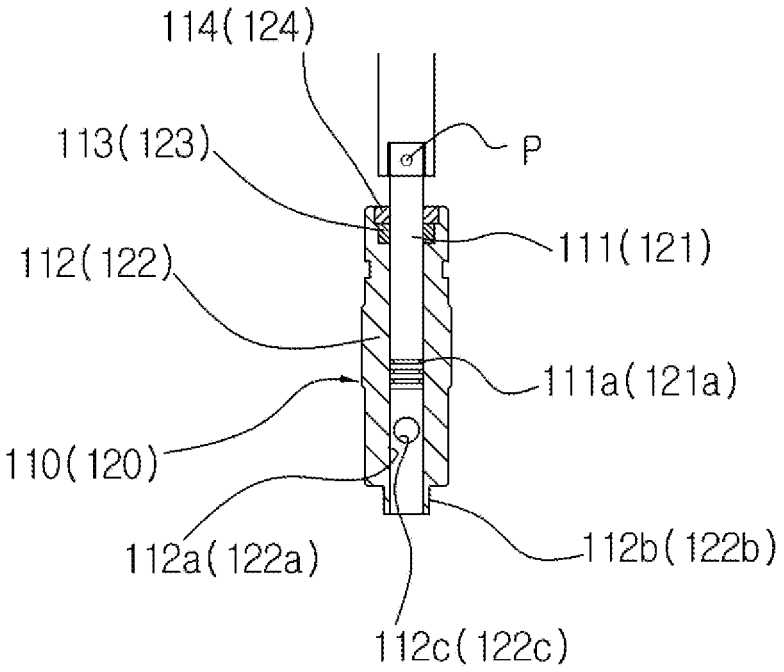
Figure 6:
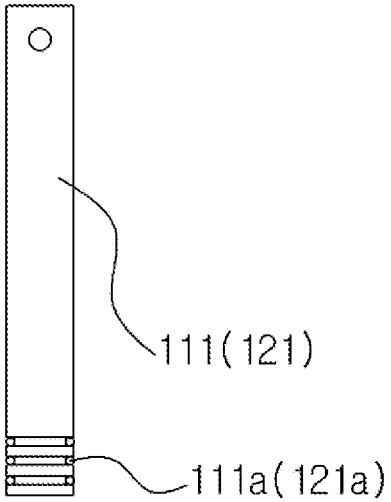
Figure 7:
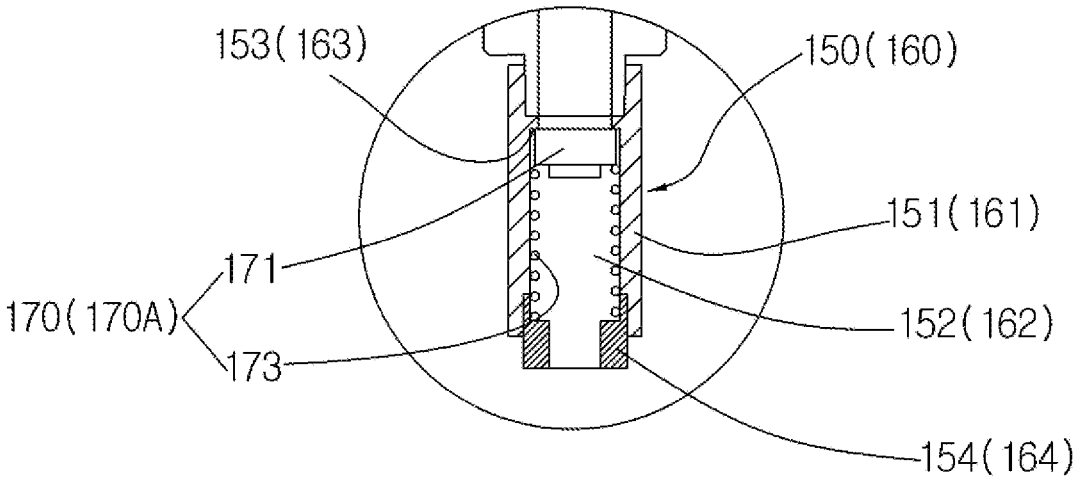
Figure 8:
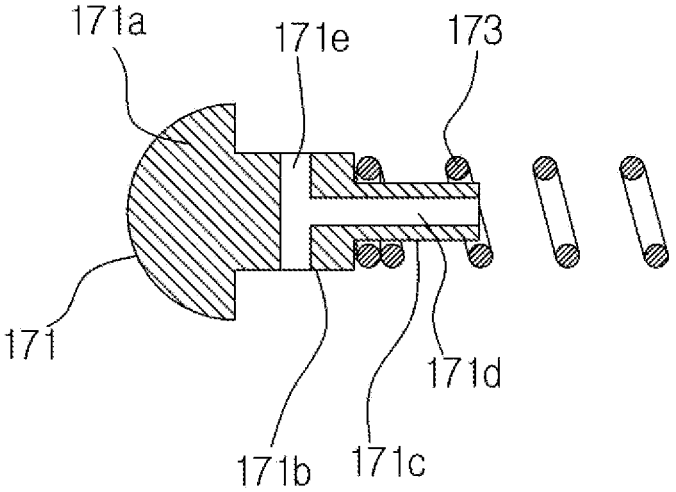
Figure 9:
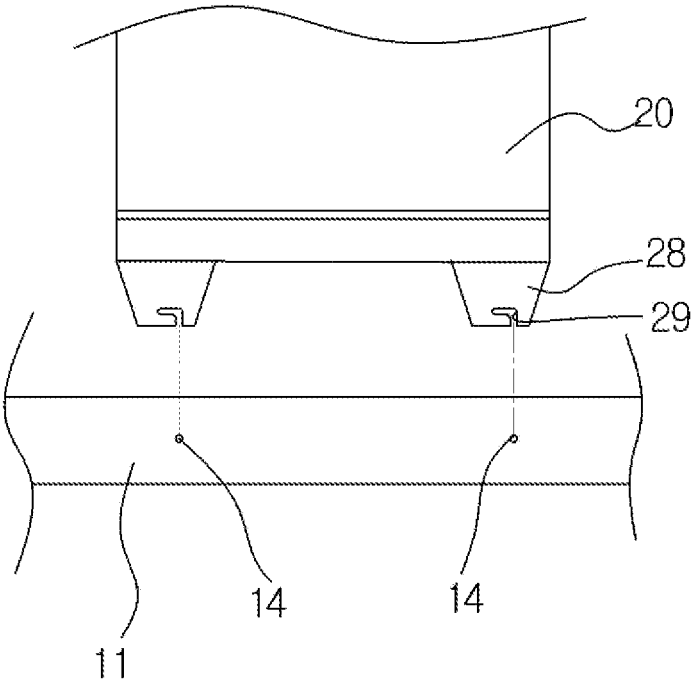
Figure 10:
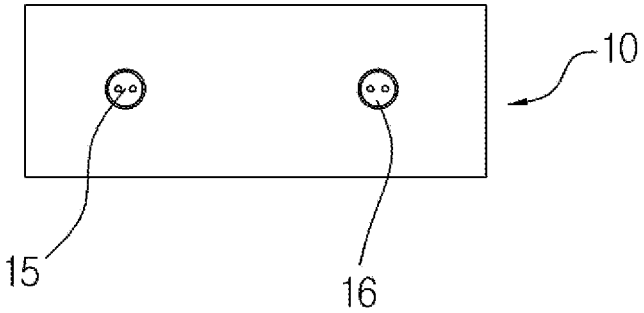

Referring to FIGS. 2 to 4, the first and the second operating block 110, 120 includes: a first and a second piston rod 111, 121 that are connected to the pumping means 50 through pins P; a first and a second cylinder 112, 122 which the first and the second piston rod 111, 121 are connected to and both sides of which open in a longitudinal direction; oil seals 113, 123 that are inserted into the backs of the first and the second cylinder 112, 122 and that prevent leakage of the source materials; and sockets 114, 124 that finish at the backs of the oil seals through screw connections.

In this instance, the oil seal 113, 123 may be retainer the inner wing and the outer wing of which are connected and elastically deformed by an external force, thereby closely sealing between the outer circumferences of the piston rod 111, 121 and the cylinder 112, 122.

Desirably, the first and the second operating block 110, 120 may be directly connected to the linear motion operating shaft 55, or as illustrated in FIG. 4, may be connected through the first and the second piston rod 111, 121 using pin connection.

Meanwhile, the first and the second piston rod 111, 121 may include o-rings 111*a*, 121*a* that are put on the outer circumference.

In this instance, the o-rings 111*a*, 121*a* formed on the outer circumferences of the first and the second piston rod 111, 121 may be at least three o-rings that are arranged with constant spacing in a longitudinal direction of the first and the second piston rod 111, 121.

Accordingly, this structure with the o-rings 111*a*, 121*a* can minimize friction between the cylinder and the piston rod that linearly reciprocate through a bore passage, the inside of the cylinder. The friction between the cylinder and the piston rod may be minimized according to injection of lubricant such as grease.

The first and the second cylinder 112, 122 include: a first and a second bore passage 112*a*, 122*a* that the first and the second piston rod 111, 121 reciprocate inside; screw connecting parts 112*b*, 122*b* that communicate with the first and the second bore passage 112*a*, 122*a* and that are connected to the first and the second transferring pipe 150, 160; and a first and a second supplying connector 112*c*, 122*c* that are formed as penetrating holes at the first and the second bore passage 112*a*, 122*a* and that are supplied with the source materials from the tanks 20.

The first and the second supplying pipe 130, 140 are connected to the first and the second operating block 110, 120 and supply the source materials from tanks 20. The first and the second supplying pipe 130, 140 include: supplying pipe bodies 131, 141 that are connected to injection hose 26, 27 of the tank 20; and sockets 132, 142 that are connected and fastened to the first and the second operating block 110, 120.

The first and the second transferring pipe 150, 160 are installed in fronts of the first and the second operating block 110, 120 and transfer the source materials into the injection nozzle 60, and include: transferring pipe bodies 151, 161; transferring passages 152, 162 that the source materials are transferred through; and sockets 154, 164 that are connected to the fronts of the transferring passage 152, 162 that the repair material is transferred through.

In this instance, a first and a second check valve 170, 170A for preventing backflow are installed at the transferring passages 152, 162 of the transferring pipe bodies 151, 161. Hereafter, the first check valve 170 will be explained. The second check valve 170A has the same structure and function as the first check valve 170. In FIG. 3, the check valve located inside the transferring passage 152, 162 is denoted by reference number 170.

The first and the second transferring pipe 152, 162 include valve-sitting raised spots 153, 163 therein that are formed with inner diameters smaller than that of the transferring passage 152, 162. At the valve-sitting raised spots 153, 163, each of the first and the second check valve 170, 170A is formed to include: a backflow prevention valve 171 that opens and closes the transferring passage 152, 162; and an elastic spring 173 that is closely connected to the backflow prevention valve 171.

Meanwhile, the transferring pipe 150, 160 may be embodied to be connected to the sockets 154, 164 that can support the end of the elastic spring 173 and transfer the source materials.

In this instance, the backflow prevention valve 171 may be formed to have a curved shape in the outer circumference surface thereof to spray the main agent and the curing agent smoothly.

The backflow prevention valve 171 may further include: a valve head part 171*a* that sits on the valve-sitting raised spot 153, 163, opens and closes the transferring passage 152, 162; a core part 171*b* that is extended from the valve head part 171*a* and has an outer diameter that is smaller than that of the valve head part 171*a*; a spring fixing part 171*c* that has an outer diameter that is smaller than that of the core part 171*b* and that is connected to the elastic spring 173; a guiding groove 171*d* that is formed inside the spring fixing part 171*c* and opens toward the passage to increase the effects of the backflow prevention; and a guiding hole 171*e* that is formed inside the core part 171*b* and that communicate with the guiding groove 171*d*.

In this instance, as the core part 171*b* and the spring fixing part 171*c* have outer diameters that are smaller than that of the valve head part 171*a*, distances between the inner side of transferring passage 152, 162 and the outer side of the backflow prevention valve 171 increases, thereby inducing quick discharging of the main agent and the curing agent. A raised spot between the core part 171*b* and the spring fixing part 171*c* may be used to support the end of the elastic spring 173.

The guiding groove 171*d* assists the first and the second check valve 170, 170A to move backward more quickly when the first and the second piston rod 111, 121 move backward. Specifically, when the first and the second piston rod 111, 121 move backward, the main agent and the curing agent inside the transferring passages 152, 162 flow into the guiding groove 171*d*, and the first and the second check valve 170, 170A retreat more quickly due to the inflow materials and close the transferring passage with bigger pressure.

The guiding hole 171*e* is formed inside the core part 171*b* and arranged in radial layout, opening toward the outer circumference. The guiding hole 171*e* communicates with the guiding groove 171*d*, thereby preventing contamination caused by stagnation of the main agent and the curing agent that are flowed into the guiding groove 171*d*.

In this instance, when the main agent and the curing agent are injected, the source materials can be flowed through the guiding hole 171*e* and the guiding groove 171*d*.

The elastic spring 173 is a coil spring. One end of the elastic spring 173 in a longitudinal direction is supported by the core part 171*b* in such a way that the one end of the elastic spring 173 is put on the spring fixing part 171*c*, and the other end is supported by the inner circumference of the sockets 154, 164.

The pressure controller 180 is installed to be connected to one of the first and the second transferring pipe 150, 160, and to control the source materials. In FIG. 3, the pressure controller 180 may be installed to be connected to the first transferring pipe 150, for example. The pressure controller 180 includes: a pipe junction part 181 meeting with the first transferring pipe 150; a pipe connecting part 182 extending backward in a longitudinal direction; and a body 183 that is fixed on the top of the chassis frame 10, connected to the pipe connecting part 182, and has a pressure control knob on the top thereof.

Meanwhile, the present invention may further include third check valve inside the first transferring pipe 150 that is connected to the pressure controller 180, in order to control the source materials transferred through the transferring pipe 150, according to pressure difference.

The third check valve 190 is a general check valve for pipe that can open and close according to the pressure controller 180, and detailed explanation will be omitted. In FIG. 3, the location of the third check valve 190 is denoted by reference number 190.

Meanwhile, the present invention may further include a pressure gauge 70 that is installed at one side of the injection nozzle 60. The pressure gauge 70 allows a user to check gauge while controlling the pressure controller 180, thereby assisting smooth injection of the repair material Hereafter, a repair process of a concrete structure using the portable device for injecting concrete repair material according to the present invention will be explained.

First, the portable device for injecting concrete repair material of the present invention is moved to the construction site that requires the concrete repair. When the device is turned on after placing the injection nozzle 60 on the cracks, the mixture of the main agent and the curing agent stored in the tanks 20 is sprayed through the injection nozzle 60 by the pumping mean 50 and fills the crack.

The motor 51 as a driving part is supplied with power and generates a rotational force. The rotational force is transmitted to the follower gear 53 through the driver gear 52. The rotational force of the follower gear 53 is converted to the linear reciprocating motion by the crank shaft 54 and transmitted to the first and the second operating block 110, 120, the source material supplying means 100.

The linear reciprocating motions of the first and the second operating block 110, 120 are transmitted to the first and the second piston rod 111, 121, and then the first and the second piston rod 111, 121 reciprocate inside the first and the second cylinder 112, 122. When the first and the second piston rod 111, 121 move backward, the main agent and the curing agent are suctioned into the first and the second cylinder 112, 122. When the first and the second piston rod 111, 121 move forward, the main agent and the curing agent are forced toward the first and the second transferring pipe 150, 160, and discharged through the final injection nozzle 60.

Furthermore, the pressure controller 180 can be used to control the discharge amounts of the repair material by adjusting the pressure level. The pressure controller 180 can be operated by adjusting the number of rotation of the motor, thereby preventing breakdowns of the motor that are caused by frequent rotations and increasing efficiency of the device.

According to the first and the second check valve 170, 170A installed in the source material supplying mean 100, when the main agent and the curing agent are injected into the source material supplying mean 100, the main agent and the curing agent push the first and the second check valve 170, 170A and compress the elastic spring 173. In this instance, the first and the second transferring pipe 150, 160 open, and the main agent and the curing agent pass the outer circumference of the first and the second valve 170, 170A and are exposed to the transferring passages 152, 162. Partial amounts of the main agent and the curing agent are flowed into the guiding hole 171*e* and then discharged through the guiding groove 171*d*. Accordingly, the main agent and the curing agent can flow more smoothly than when the main agent and the curing agent flows only through the outer circumference of the first and the second check valve 170, 170A. In addition, the main agent and the curing agent that are discharged through the guiding groove 171*d* accelerate the flowing speed of the main agent and the curing agent that flow along the outer circumference of the check valve 170, 170A and prevent circulatory disturbance.

In addition, the third check valve 190 that is operated by the pressure controller 180 can adjust the discharge amount of the repair material and maintain the lifespan of the motor to be longer by controlling the number of rotations of the motor.

While embodiments of the present invention have been described, the present invention is not limited to what has been particularly shown. It would be apparent that many more modifications and variations than mentioned above are possible by an ordinary person skilled in the art. The scope of the present invention includes scopes of appended claims, modifications, and variations.

What is claimed is:

1. A portable device for injecting repair material, the portable device comprising:

a chassis frame including a movable wheel and a handle;

tanks mounted on the chassis frame and storing source materials including a main agent and a curing agent, separately;

pumping means pumping the main agent and the curing agent stored in the tanks by a driving part of a motor;

an injection nozzle mixing the main agent and the curing agent pumped by the pumping means into repair material and injecting the repair material into cracks of a concrete structure; and source material supplying means that are separately installed between the pumping mean and the injection nozzle, supplied with the source materials from the tank, and transfer the source materials into the injection nozzle, the source material supplying means including:

a first and a second operating block that are connected to the pumping means and each consists of a cylinder and a piston that discharge the source materials;

a first and a second supplying pipe that are respectively connected to one sides of the first and the second operating block and are supplied with the source materials from the tanks;

a first and a second transferring pipe that are connected to the fronts of the first and the second operating block and transfer the source materials into the injection nozzle, a pressure controller that is connected to one of the first and the second transferring pipe and that controls an amount of the source materials, a first and a second check valve for preventing backflow that are installed inside the first and the second transferring pipe, respectively, and a third check valve that is connected to the pressure controller, wherein the third check valve is formed inside one of the first and the second transferring pipe in order to control the source materials transferred through the transferring pipe according to pressure difference, wherein the third check valve opens and closes according to control of the pressure controller, wherein by adjusting the third check valve, a discharge amount of the source materials is adjusted, and the repair material for injection is controlled, wherein a pressure gauge is installed at one side of the injection nozzle, and allows a user to check gauge while controlling the pressure controller and injecting the repair material.

2. The portable device of claim 1, wherein the first and the second operating block including:

a first and a second piston rod that are connected to the pumping means through pins;

a first and a second cylinder both sides of which open in a longitudinal direction, and one sides of which the first and the second piston rod are connected to;

oil seals that are inserted into the backs of the first and the second cylinder and that prevent leakage of the source materials; and sockets that the first and the second rod penetrate through, and that are placed at the backs of the oil seals through screw connections, wherein the first and the second piston rod further include o-rings that are put on outer circumferences of one ends thereof.

3. The portable device of claim 2, wherein the o-rings formed on the outer circumferences of the first and the second piston rod include at least three o-rings that are arranged with constant spacing in a longitudinal direction of the first and the second piston rod.

4. The portable device of claim 1, wherein the first and the second transferring pipe include:

transferring pipe bodies;

transferring passages that the source materials are transferred through; and valve-sitting raised spots that are formed at the transferring passages with inner diameters that is smaller than that of the transferring passage, wherein the first and second check valves are formed at the valve-sitting raised spots, and each includes:

a backflow prevention valve that opens and closes the transferring passage, and an elastic spring that is closely connected to the backflow prevention valve.

5. The portable device of claim 4, wherein each of the first and the second transferring pipe includes:

a valve head part that sits on the valve-sitting raised spot, opens and closes the transferring passage;

a core part that is extended from the valve head part and that has an outer diameter that is smaller than that of the valve head part, a spring fixing part that has an outer diameter that is smaller than that of the core part and that is connected to the elastic spring;

a guiding groove that is formed inside the spring fixing part and that opens toward the transferring passage, and a guiding hole that is formed inside the core part and that communicates with the guiding groove.

6. The portable device of claim 1, wherein the pressure controller includes:

a pipe junction part that meets with one of the first and the second transferring pipe;

a pipe connecting part that extends backward in a longitudinal direction, and a body that is fixed on the top of the chassis frame, connected to the pipe connecting part, and has a pressure control knob on the top thereof.

7. The portable device of claim 1, wherein at the bottom of the tank includes at least 4 protrusion extending parts, wherein the protrusion extending part includes an inner introducing groove that is formed inward thereof to be engaged with a protruding part that is protrudingly formed on the chassis frame, so that the tank is stably placed on the top of the chassis frame.

* * * * *